US008678798B2

(12) United States Patent
Nakamura et al.

(10) Patent No.: US 8,678,798 B2
(45) Date of Patent: Mar. 25, 2014

(54) ROTARY PUMP DEVICE HAVING SEAL MECHANISM WHICH INCLUDES RESIN MEMBER AND REINFORCING RING IN HOLLOW PORTION OF RESIN MEMBER

(75) Inventors: Yuki Nakamura, Kariya (JP); Kunihito Ando, Okazaki (JP); Nobuhiko Yoshioka, Anjo (JP); Takahiro Naganuma, Kariya (JP); Tomoaki Kawabata, Takahama (JP)

(73) Assignees: Advics Co., Ltd., Kariya, Aichi-Pref. (JP); Denso Corporation, Kariya, Aichi-Pref. (JP)

( * ) Notice: Subject to any disclaimer, the term of this patent is extended or adjusted under 35 U.S.C. 154(b) by 277 days.

(21) Appl. No.: 13/220,382

(22) Filed: Aug. 29, 2011

(65) Prior Publication Data

US 2012/0051960 A1 Mar. 1, 2012

(30) Foreign Application Priority Data

Aug. 31, 2010 (JP) ..... 2010-194638

(51) Int. Cl.
*F01C 19/00* (2006.01)
*F03C 2/00* (2006.01)
*F03C 4/00* (2006.01)

(52) U.S. Cl.
USPC ..... 418/104; 418/128; 418/129; 418/152; 418/171; 277/573; 277/575; 277/589

(58) Field of Classification Search
USPC ..... 418/104, 128–129, 132, 152, 154–155, 418/166, 171, 75, 77, 79; 277/573, 575, 277/589
See application file for complete search history.

(56) References Cited

U.S. PATENT DOCUMENTS

| | | | | |
|---|---|---|---|---|
| 2,697,623 | A * | 12/1954 | Mosher | 277/573 |
| 6,273,527 | B1 * | 8/2001 | Yamaguchi et al. | 418/171 |
| 6,783,193 | B2 * | 8/2004 | Yamaguchi et al. | 418/171 |
| 6,905,321 | B2 * | 6/2005 | Uchiyama et al. | 418/171 |
| 2006/0093507 | A1 | 5/2006 | Yamaguchi et al. | |
| 2010/0060074 | A1 * | 3/2010 | Yamaguchi et al. | 418/171 |

FOREIGN PATENT DOCUMENTS

JP 2006-125272 A 5/2006

* cited by examiner

*Primary Examiner* — Theresa Trieu
(74) *Attorney, Agent, or Firm* — Buchanan Ingersoll & Rooney PC

(57) ABSTRACT

A rotary pump device is provided in which a drive shaft is inserted into a center hole of a cylinder that forms rotor chambers, and into outer rotors and inner rotors of rotary pumps. In the rotary pump device, seal mechanisms that include hollow-shaped resin members and annular rubber members are arranged on an opposite side to the cylinder with respect to the rotary pumps. Metal rings are arranged in hollow portions of the resin members in the seal mechanisms so that the drive shaft is inserted into an inner periphery of the metal rings with a minimum clearance.

6 Claims, 7 Drawing Sheets

ROTARY PUMP DEVICE HAVING SEAL MECHANISM WHICH INCLUDES RESIN MEMBER AND REINFORCING RING IN HOLLOW PORTION OF RESIN MEMBER

TECHNICAL FIELD

The present invention relates to a rotary pump device provided with a rotary pump, such as a trochoid pump.

BACKGROUND ART

In related art, PTL 1 discloses a brake device having a structure in which a cylinder-shaped pump body that incorporates a rotary pump is inserted into and fixed to a recessed portion of a housing of a brake fluid pressure control actuator. In this rotary pump device, a cylinder is arranged on both end faces in an axial direction of the rotary pump having an outer rotor and an inner rotor. A seal member housed in the cylinder and a seal surface formed on the cylinder come into contact with the outer rotor and the inner rotor, thereby forming a seal between a relatively low-pressure area and a relatively high-pressure area of the rotary pump.

CITATION LIST

Patent Literature

[PTL 1]
Japanese Patent Application Publication No. JP-A-2006-125272

SUMMARY OF INVENTION

Technical Problem

In the above-described rotary pump device disclosed in PTL 1, in order to improve pump efficiency, it is important to ensure accuracy of contact positions of the outer rotor and the inner rotor with the seal member and the seal surface. In order to achieve this, it is important to improve an assembly accuracy of each of the rotors, the cylinder and the seal member.

However, with the above-described rotary pump device, sealing is performed by the seal member housed in the cylinder arranged on one end face side in the axial direction of the two rotors, while mechanical sealing is performed by the seal surface of the cylinder arranged on the other end face side. With this type of structure, the cylinders on the both sides are assembled using a drive shaft as a reference. However, in addition to an assembly error of the two cylinders with respect to the drive shaft, an assembly error between the seal member housed in the cylinder and the cylinder occurs. It is therefore difficult to accurately assemble the drive shaft, consequently, the two rotors and the seal member.

In light of the foregoing, it is an object of the present invention to provide a rotary pump device that is capable of reducing an assembly error and improving pump efficiency.

Solution to Problem

In order to achieve the above-described object, according to a first aspect of the present invention, there is provided a rotary pump device that includes a cylinder which forms a rotor chamber in which the rotary pump is housed, and forms a mechanical seal by coming into contact with one end face in an axial direction of the outer rotor and the inner rotor, and which includes a center hole into which the drive shaft is inserted. The rotary pump device also includes a seal mechanism which forms the rotor chamber together with the cylinder, and which includes a hollow plate-shaped resin member having a seal surface that comes into contact with another end face in the axial direction of the outer rotor and the inner rotor, and a hollow portion into which the drive shaft is inserted. The seal mechanism presses the seal surface against the rotary pump by introducing a discharge pressure of the rotary pump to a side of the resin member that is opposite to the rotary pump, and the seal mechanism includes a reinforcing ring in the hollow portion of the resin member. The reinforcing ring is formed of a material whose hardness is higher than that of the resin member, and has an inner peripheral surface that is caused to be slidably in contact with the drive shaft.

In the rotary pump device structured in this manner, the rotary pump, the cylinder and the seal mechanism are assembled using the drive shaft as a reference. Therefore, the cylinder and the drive shaft are assembled with almost no axial displacement. In addition, since the drive shaft is slidably inserted into the inner periphery of the reinforcing ring, the seal mechanism and the drive shaft are assembled with almost no axial displacement. Accordingly, the cylinder and the seal mechanism that have been assembled using the drive shaft as a reference are assembled on both end faces of the rotary pump with almost no assembly error. Thus, it is possible to further reduce the assembly error, and it is possible to improve pump efficiency.

According to a second aspect of the present invention, a seal member is provided which surrounds a periphery of the drive shaft and which abuts on the seal mechanism. Protruding and recessed portions that are engaged with each other are respectively formed on the seal mechanism and the seal member, and the protruding and recessed portions restrict rotation of the seal member along with rotation of the drive shaft.

In this manner, the rotation of the seal member along with the rotation of the drive shaft can be restricted by engaging the protruding and recessed portions that are respectively provided on the seal mechanism and the seal member. Thus, it is possible to achieve simplification of the structure.

According to a third aspect of the present invention, the rotary pump and the seal mechanism are doubly provided, and each pair of the rotary pump and the seal mechanism is provided on each sides in an axial direction of the cylinder. The two seal mechanisms are pressed toward the cylinder by a discharge pressure, and thus the two rotary pumps are pressed by the two seal mechanisms.

In this manner, since the two seal mechanisms are pressed from the outside of the cylinder by a discharge pressure, the both end faces of the rotary pumps can be sealed without generating an axial force to mechanically press the seal mechanisms. Thus, it is possible to achieve simplification of the structure.

According to a fourth aspect of the present invention, a bearing that supports the drive shaft is provided in the center hole of the cylinder.

In this manner, the bearing may be provided in the center hole of the cylinder. The bearing has a very small dimensional tolerance in a radial direction. In addition, an inner periphery of the bearing directly comes into contact with the drive shaft, and an outer periphery of the bearing directly comes into contact with the center hole of the cylinder. Therefore, axial centers of the cylinder and the drive shaft are easily aligned, and assembly workability is improved.

According to a fifth aspect of the present invention, the seal mechanism includes an anti-rotation structure that restricts the seal mechanism from rotating in a circumferential direction of the drive shaft.

Since the anti-rotation structure is provided in this manner, it is possible to suppress a positional displacement in a rotation direction of the cylinder and of the seal mechanism, and it is possible to further reduce the assembly error. Thus, it is possible to further improve the pump efficiency.

According to a sixth aspect of the present invention, a housing is formed of an aluminum material as is the case with the cylinder, the housing having an inner space in which the rotary pump and the cylinder are housed.

When the housing and the cylinder are formed of the same aluminum material in this manner, there is no difference between their thermal expansion coefficients. As a result, there is no need to take account of absorption of thermal stress, and there is no need to provide a disc spring or the like that is necessary in related art. It is therefore possible to achieve a further reduction in an axial direction length of a pump body as well as achieve weight reduction.

Note that, the reference numbers in brackets for each of the above-described units are intended to show the relationship with the specific units described in the following embodiments.

BRIEF DESCRIPTION OF DRAWINGS

FIG. 2-*b* is a cross-sectional diagram of a leading end portion of the pump body 100 in a cross section different from that in FIG. 2-*a;*

DESCRIPTION OF EMBODIMENTS

Figure 1:
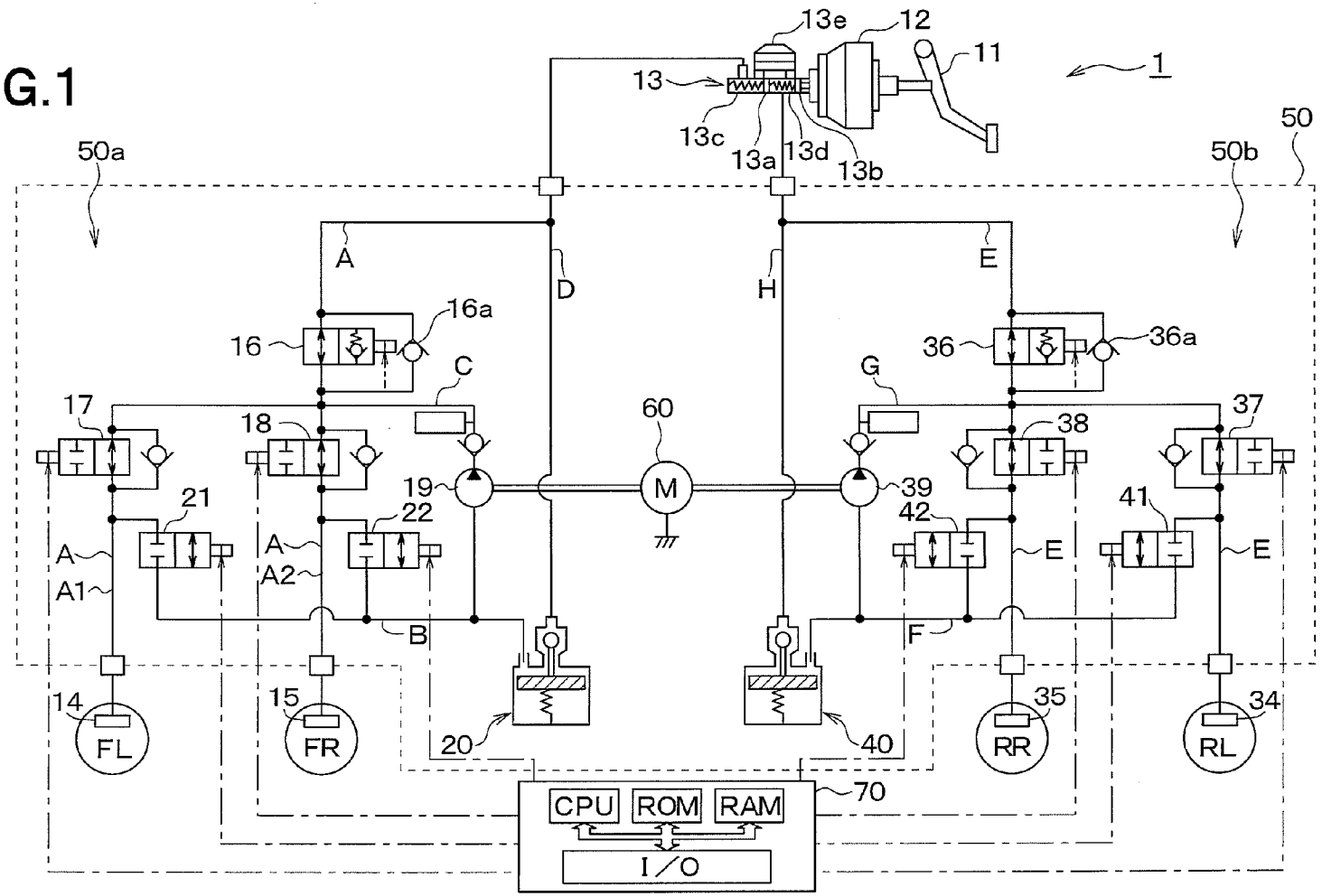
FIG. 1 is a brake piping schematic diagram of a vehicle brake device to which a rotary pump device according to a first embodiment of the present invention is applied.

Hereinafter, embodiments of the present invention will be explained based on the drawings. Note that portions that are the same or equivalent to each other in each of the embodiments that are hereinafter described are assigned the same reference numerals in the drawings.

First Embodiment

Hereinafter, the embodiments of the present invention that are shown in the drawings will be explained. FIG. 1 shows a brake piping schematic diagram of a vehicle brake device to which a rotary pump device according to a first embodiment of the present invention is applied. Hereinafter, a basic structure of the vehicle brake device will be explained based on FIG. 1. Here, an example will be explained in which the vehicle brake device according to the present invention is applied to a front wheel drive four-wheeled vehicle that includes a hydraulic circuit in a front-rear piping arrangement. However, the present invention can also be applied to an X piping arrangement that includes respective piping systems of right front wheel to left rear wheel, and left front wheel to right rear wheel.

As shown in FIG. 1, when a driver depresses a brake pedal 11, which is a brake operating member, the depression force is boosted by a servo unit 12 and pushes master pistons 13*a*, 13*b* that are disposed in a master cylinder (hereinafter referred to as an M/C) 13. As a result, a same M/C pressure is generated in a primary chamber 13*c* and a secondary chamber 13*d* that are demarcated by the master pistons 13*a*, 13*b*. The M/C pressure is transmitted to respective wheel cylinders (hereinafter referred to as W/Cs) 14, 15, 34, 35 via a brake fluid pressure control actuator 50. The M/C 13 is provided with a master reservoir 13*e* having passages that communicatively connect with the primary chamber 13*c* and the secondary chamber 13*d*, respectively.

The brake fluid pressure control actuator 50 is provided with a first piping system 50*a* and a second piping system 50*b*. The first piping system 50*a* controls the brake fluid pressure applied to a left front wheel FL and a right front wheel FR, while the second piping system 50*b* controls the brake fluid pressure applied to a right rear wheel RR and a left rear wheel RL.

The first piping system 50*a* and the second piping system 50*b* have a same structure. Therefore, hereinafter, the first piping system 50*a* will be explained and an explanation of the second piping system 50*b* will be omitted.

The first piping system 50*a* is provided with a conduit A which transmits the above-described M/C pressure to the W/C 14 provided in the left front wheel FL and to the W/C 15 provided in the right front wheel FR, and which serves as a main conduit that generates a W/C pressure.

The conduit A is provided with a first differential pressure control valve 16 that can be controlled to a communicated state and a differential pressure state. A valve position of the first differential pressure control valve 16 is adjusted such that the first differential pressure control valve 16 is in the communicated state during normal braking (when vehicle motion control is not being performed) when the driver performs an operation of the brake pedal 11. When a current is applied to a solenoid coil provided in the first differential pressure control valve 16, the valve position is adjusted such that, the larger the value of the current is, the larger the differential pressure is.

In a case where the first differential pressure control valve 16 is in the differential pressure state, the brake fluid is allowed to flow from the W/C 14, 15 side to the M/C 13 side only when the brake fluid pressure on the W/C 14, 15 side is higher than the M/C pressure by a predetermined pressure or more. Therefore, the brake fluid pressure on the W/C 14, 15 side is constantly maintained not to become higher than the pressure on the M/C 13 side by the predetermined pressure or more.

The conduit A branches into two conduits A1, A2 on the W/C 14, 15 side, which is downstream of the first differential pressure control valve 16. A first pressure increasing control valve 17, which controls a pressure increase in the brake fluid pressure to the W/C 14, is provided in the conduit A1. A second pressure increasing control valve 18, which controls a pressure increase in the brake fluid pressure to the W/C 15, is provided in the conduit A2.

The first and the second pressure increasing control valves 17, 18 are each formed by a two-position electromagnetic valve that can be controlled between a communicated state and a closed state. More specifically, the first and the second pressure increasing control valves 17, 18 are normally open valves in which, when a control current applied to solenoid coils provided in the first and the second pressure increasing control valves 17, 18 is zero (i.e. when no current is applied), they are brought into the communicated state, and when the control current is allowed to flow to the solenoid coils (i.e., when applying current), they are controlled to the closed state.

A conduit B, serving as a pressure reducing conduit, connects a portion of the conduit A between the first pressure increasing control valve 17 and the W/C 14 with a pressure adjusting reservoir 20, and connects a portion of the conduit A between the second pressure increasing control valve 18 and the W/C 15 with the pressure adjusting reservoir 20. The conduit B is provided with a first pressure reducing control valve 21 and a second pressure reducing control valve 22 that are each formed by a two-position electromagnetic valve that can be controlled between a communicated state and a closed state. The first and the second pressure reducing control valves 21, 22 are normally closed valves.

A conduit C, serving as a reflux conduit, is provided between the pressure adjusting reservoir 20 and the conduit A that is the main conduit. The conduit C is provided with a self-priming pump 19 that is driven by a motor 60 and that sucks the brake fluid from the pressure adjusting reservoir 20 and discharges it to the M/C 13 side or to the W/C 14, 15 side. The motor 60 is driven by controlling current supply to a motor relay, which is not shown in the drawings.

Further, a conduit D, serving as an auxiliary conduit, is provided between the pressure adjusting reservoir 20 and the M/C 13. The brake fluid is sucked by the pump 19 from the M/C 13 through the conduit D and discharged to the conduit A. As a result, the brake fluid is supplied to the W/C 14, 15 side during vehicle motion control, and the W/C pressure of a target wheel is thereby increased. Note that, although the first piping system 50*a* is explained here, the second piping system 50*b* also has a similar structure, and the second piping system 50*b* is also provided with structural elements that are similar to those provided in the first piping system 50*a*. Specifically, the second piping system 50*b* is provided with a second differential pressure control valve 36 that corresponds to the first differential pressure control valve 16, third and fourth pressure increasing control valves 37, 38 that correspond to the first and the second pressure increasing control valves 17, 18, third and fourth pressure reducing control valves 41, 42 that correspond to the first and the second pressure reducing control valves 21, 22, a pump 39 that corresponds to the pump 19, a reservoir 40 that corresponds to the reservoir 20, and conduits E to H that correspond to the conduits A to D.

A brake ECU 70 corresponds to a vehicle motion control device of the present invention that controls a control system of a brake control system 1, and is a known microcomputer that is provided with a CPU, a ROM, a RAM, an I/O port and the like. The brake ECU 70 performs processing, such as various types of calculation, according to programs stored in the ROM and the like, thus performing vehicle motion control such as antiskid control etc. More specifically, the brake ECU 70 calculates various types of physical quantities based on detection by sensors that are not shown in the drawings, and based on the calculation results, the brake ECU 70 determines whether or not to perform vehicle motion control. When the vehicle motion control is performed, the brake ECU 70 calculates a control amount for a control target wheel, namely, a W/C pressure to be generated at the W/C of the control target wheel. Based on a result of the calculation, the brake ECU 70 controls the supply of current to each of the control valves 16 to 18, 21, 22, 36 to 38, 41 and 42, and also controls the amount of current supplied to the motor 60 to drive the pumps 19, 39. Thus, the W/C pressure of the control target wheel is controlled and the vehicle motion control is performed.

When no pressure is generated at the M/C 13 as in traction control or antiskid control, for example, the pumps 19, 39 are driven, and at the same time, the first and the second differential pressure valves 16, 36 are brought into a differential state. Thus, the brake fluid is supplied through the conduits D, H to the downstream side of the first and the second differential pressure control valves 16, 36, namely, to the W/C 14, 15, 34, 35 side. Then, increase/decrease of the W/C pressure of the control target wheel is controlled by appropriately controlling the first to the fourth pressure increasing control valves 17, 18, 37, 38 or the first to the fourth pressure reducing control valves 21, 22, 41, 42. Thus, the W/C pressure is controlled to become a desired control amount.

Further, during antiskid (ABS) control, the first to the fourth pressure increasing control valves 17, 18, 37, 38 or the first to the fourth pressure reducing control valves 21, 22, 41, 42 are appropriately controlled, and at the same time, the pumps 19, 39 are driven. Thus, the increase/decrease of the W/C pressure is controlled, and the W/C pressure is controlled to become the desired control amount.

Figure 2A:
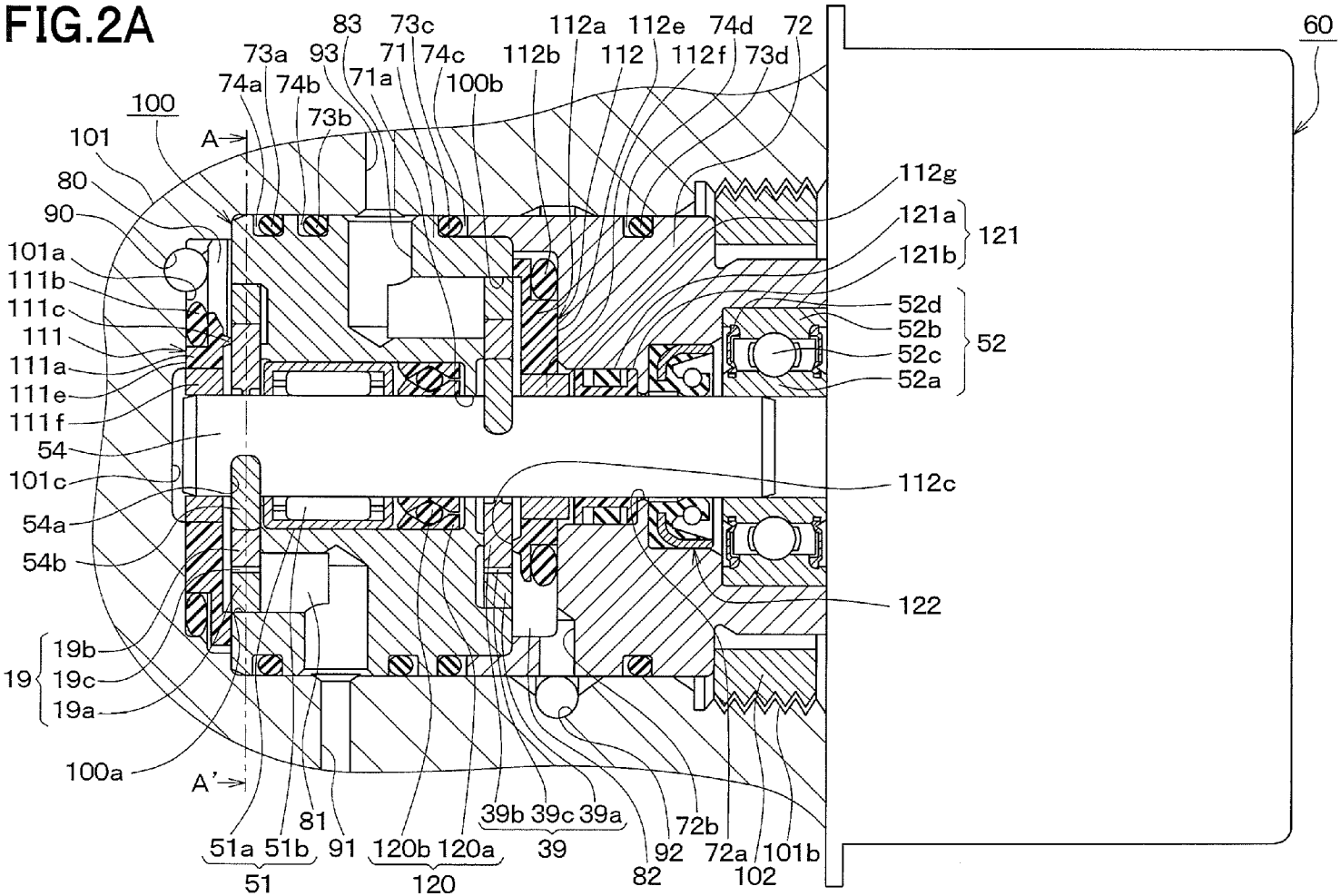
FIG. 2-*a* is a cross-sectional diagram of the rotary pump device that is provided with a pump body 100 including rotary pumps 19, 39, and with a motor 60.
Figure 2B:
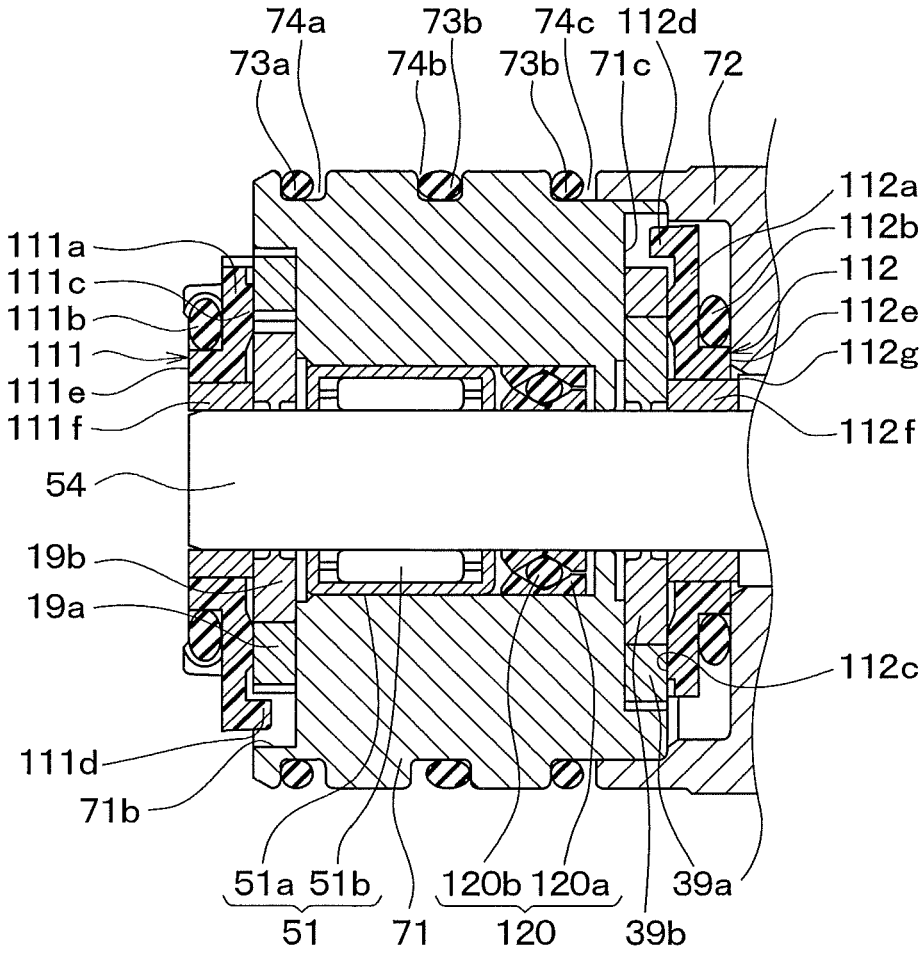

Next, a detailed structure of the rotary pump device in the vehicle brake device structured as described above will be explained. FIG. 2-*a* is a cross-sectional diagram of the rotary pump device that is provided with a pump body 100 including the rotary pumps 19, 39, and with the motor 60. FIG. 2-*a* shows a state in which the pump body 100 is assembled into a housing 101 of the brake fluid pressure control actuator 50, and the pump body 100 is assembled such that an up-down direction of the drawing is a vehicle vertical direction. FIG. 2-*b* is a cross-sectional diagram of a leading end portion of the pump body 100 in a cross section different from that in FIG. 2-*a*. FIG. 2-*b* corresponds to a drawing when the pump body 100 is cut at a cross section perpendicular to FIG. 2-*a*, along a central axis of the pump body 100.

As described above, the vehicle brake device is formed by the two systems, i.e., the first piping system and the second piping system. Therefore, the pump body 100 is provided with two pumps, i.e., the rotary pump 19 for the first piping system and the rotary pump 39 for the second piping system.

The rotary pumps 19, 39 that are incorporated in the pump body 100 are driven by the motor 60 rotating a drive shaft 54 that is supported by a first bearing 51 and a second bearing 52. A casing that forms an outer shape of the pump body 100 is formed by a cylinder 71 made of aluminum and a plug 72. The first bearing 51 is arranged in the cylinder 71 and the second bearing 52 is arranged in the plug 72.

The cylinder 71 and the plug 72 are integrated such that one end side of the cylinder 71 is press fitted into the plug 72 in a state in which the cylinder 71 and the plug 72 are coaxially arranged, thus forming the casing of the pump body 100. Further, the rotary pumps 19, 39, various types of seal members and the like are provided along with the cylinder 71 and the plug 72, thus forming the pump body 100.

The pump body 100 having an integrated structure is formed in this manner. The pump body 100 with the integrated structure is inserted into a recessed portion 101*a* from the right side of the drawing. The recessed portion 101*a* has a substantially cylindrical shape and is formed in the housing 101 made of aluminum. Then, a ring-shaped male screw member (screw) 102 is screwed into a female screw groove 101*b* that is formed in an entrance of the recessed portion 101*a*, thus fixing the pump 100 to the housing 101. Since the male screw member 102 is screwed, the pump body 100 is inhibited from being pulled out from the housing 101.

A direction in which the pump body 100 is inserted into the recessed portion 101*a* of the housing 101 is hereinafter simply referred to as an insertion direction. Further, an axial direction and a circumferential direction of the pump body 100 (an axial direction and a circumferential direction of the drive shaft 54) are hereinafter simply referred to as an axial direction and a circumferential direction.

Further, a circular-shaped second recessed portion 101*c* is formed in the recessed portion 101*a* of the housing 101, at a leading end position in the insertion direction, more specifically, at a position corresponding to a leading end of the drive shaft 54. The diameter of the second recessed portion 101*c* is made larger than the diameter of the drive shaft 54 and the leading end of the drive shaft 54 is located in the second recessed portion 101*c* so that the drive shaft 54 does not come into contact with the housing 101.

The cylinder 71 and the plug 72 are provided with center holes 71*a*, 72*a*, respectively. The drive shaft 54 is inserted into the center holes 71*a*, 72*a*, and is supported by the first bearing 51 that is fixed to an inner periphery of the center hole 72*a* formed in the cylinder 71, and by the second bearing 52 that is fixed to an inner periphery of the center hole 72*a* formed in the plug 72. Although bearings with any structure may be used as the first and the second bearing 51, 52, rolling bearings are used in the present embodiment.

Specifically, the first bearing 51 is a needle roller bearing without inner ring, and is provided with an outer ring 51*a* and a needle-shaped roller 51*b*. The drive shaft 54 is axially supported by being fitted into a hole of the first bearing 51. The diameter of the center hole 71*a* of the cylinder 71 is enlarged, at a forward portion in the insertion direction of the center hole 71*a*, to have a dimension corresponding to the outer diameter of the first bearing 51. Therefore, the first bearing 51 is fixed to the cylinder 71 by being press fitted into this enlarged diameter portion.

The second bearing 52 is structured such that it includes an inner ring 52*a*, an outer ring 52*b* and a rolling element 52*c*, and it is fixed by the outer ring 52*b* being press fitted into the center hole 72*a* of the plug 72. The drive shaft 54 is fitted into a hole in the inner ring 52*a* of the second bearing 52, and thus the drive shaft 54 is axially supported. Further, a seal plate 52*d* is also provided in the second bearing 52.

Figure 3:
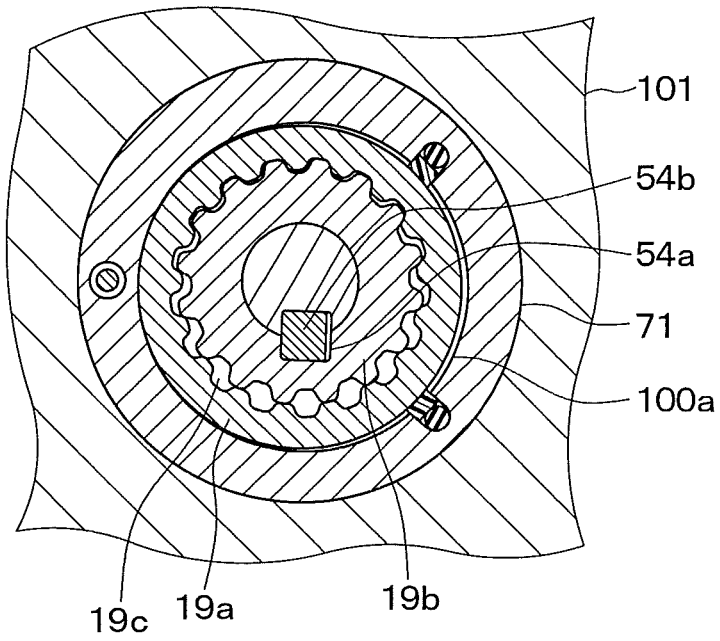
FIG. 3 is an A-A cross-sectional diagram of FIG. 2-*a;*
Figure 4B:
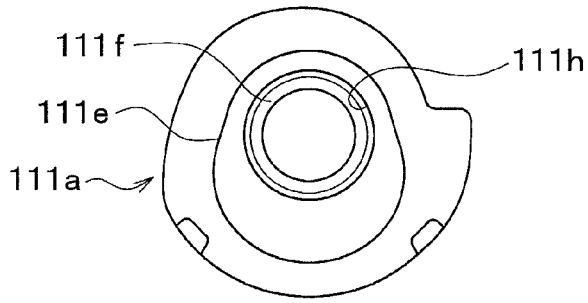
FIG. 4 is a diagram showing a detailed structure of portions of a seal mechanism 111, excluding a rubber member 111*b;*
Figure 4E:
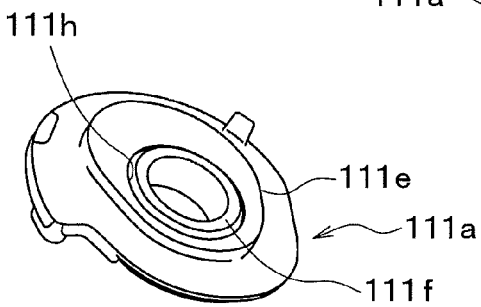
Figure 4C:
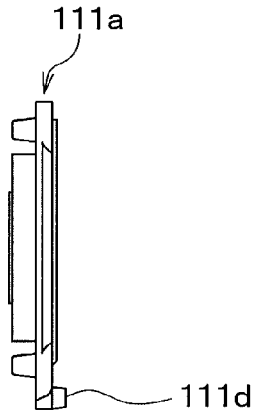
Figure 4D:
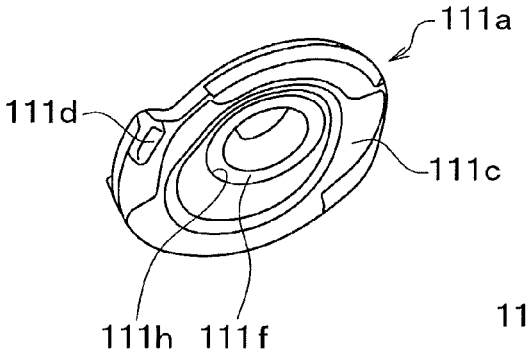
Figure 4A:
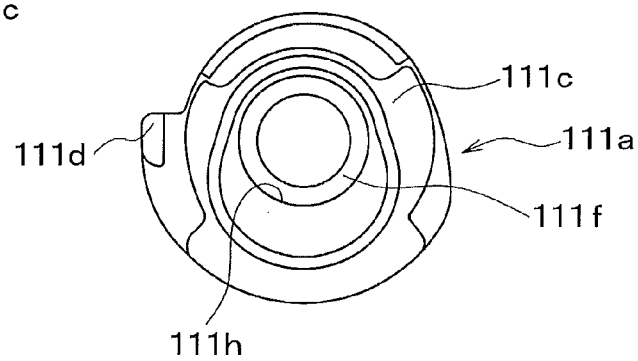
Figure 5B:
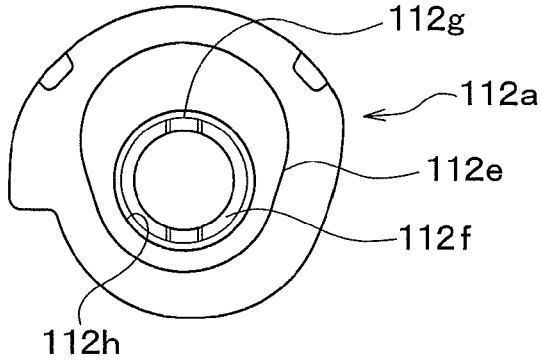
FIG. 5 is a diagram showing a detailed structure of portions of a seal mechanism 112, excluding a rubber member 112*b;*
Figure 5E:
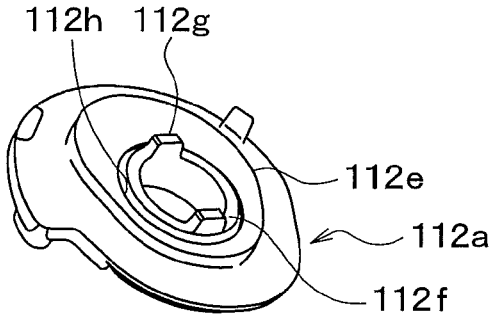
Figure 5C:
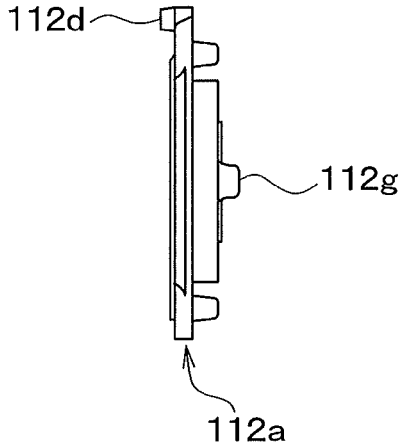
Figure 5D:
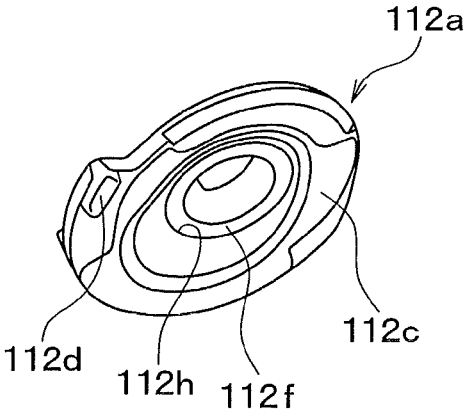
Figure 5A:
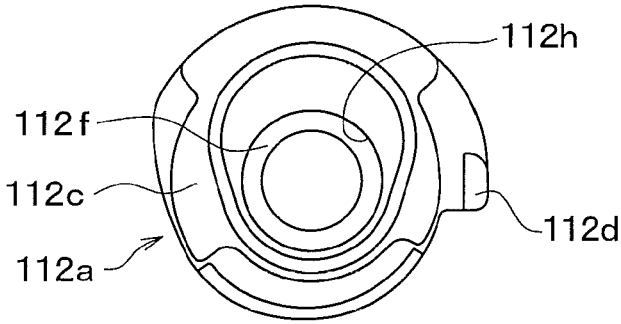

The rotary pumps 19, 39 are respectively provided on both sides of the first bearing 51, namely, in an area located further forward in the insertion direction than the first bearing 51, and an area sandwiched by the first and the second bearings 51, 52. Detailed structures of the rotary pumps 19, 39 will be explained with reference to FIG. 3, which shows an A-A cross-sectional diagram of FIG. 2-*a*.

The rotary pump 19 is arranged in a rotor chamber 100*a*, which is a circular-shaped recessed counterbore formed in one end face of the cylinder 71. The rotary pump 19 is an internal gear pump (a trochoid pump), which is driven by the drive shaft 54 that is inserted into the rotor chamber 100*a*.

Specifically, the rotary pump 19 is provided with a rotating portion that is formed by: an outer rotor 19*a* having an inner periphery on which an inner teeth portion is formed; and an inner rotor 19*b* having an outer periphery on which an outer teeth portion is formed. The drive shaft 54 is inserted into a hole formed in the center of the inner rotor 19*b*. A key 54*b* is fittingly inserted into a hole 54*a* formed in the drive shaft 54, and a torque is transmitted to the inner rotor 19*b* by the key 54*b*.

The inner teeth portion and the outer teeth portion that are respectively formed on the outer rotor 19*a* and the inner rotor 19*b* are engaged with each other, and a plurality of void portions 19*c* are thereby formed. Sizes of the void portions 19*c* are changed by rotation of the drive shaft 54, and thus the brake fluid is sucked and discharged.

On the other hand, the rotary pump 39 is arranged in a rotor chamber 100*b*, which is a circular-shaped recessed counterbore formed in the other end face of the cylinder 71, and the rotary pump 39 is driven by the drive shaft 54 that is inserted into the rotor chamber 100*b*. Similarly to the rotary pump 19, the rotary pump 39 is also an internal gear pump that is provided with an outer rotor 39*a* and an inner rotor 39*b*, and sucks and discharges the brake fluid using a plurality of void portions 39*c* that are formed by two teeth portions of the outer rotor 39*a* and the inner rotor 39*b* being engaged with each other. The rotary pump 39 is arranged such that the rotary pump 19 is rotated by approximately 180 degrees centered on the drive shaft 54. With this type of arrangement, the suction-side void portions 19*c*, 39*c* and the discharge-side void portions 19*c*, 39*c* of the respective rotary pumps 19, 39 are symmetrically positioned with the drive shaft 54 as a center. Thus, it is possible to cancel out forces applied to the drive shaft 54 by a high-pressure brake fluid on the discharge side.

A seal mechanism 111 that presses the rotary pump 19 to the cylinder 71 side is provided on the one end face side of the cylinder 71, on an opposite side to the cylinder 71 with respect to the rotary pump 19, namely, between the cylinder 71 and the rotary pump 19, and the housing 101. Further, a seal mechanism 112 that presses the rotary pump 39 to the cylinder 71 side is provided on the other end face side of the cylinder 71, on an opposite side to the cylinder 71 with respect to the rotary pump 39, namely, between the cylinder 71 and the rotary pump 39, and the plug 72.

The seal mechanism 111 is formed by a ring-shaped member having a center hole into which the drive shaft 54 is inserted, and forms a seal between a relatively low-pressure section and a relatively high-pressure section on the one end face side of the rotary pump 19, by pressing the outer rotor 19*a* and the inner rotor 19*b* to the cylinder 71 side. Specifically, the seal mechanism 111 is formed to include a hollow plate-shaped resin member 111*a* that is arranged on the rotating portion side, and a rubber member 111*b* that presses the resin member 111*a* to the rotating portion side.

FIG. 4 is a diagram showing a detailed structure of the seal mechanism 111 (in which the annular rubber member 111*b* is removed), (a) is a diagram of the seal mechanism 111 as viewed from the right side of FIG. 2-*a*, (b) is a diagram of the seal mechanism 111 as viewed from the left side of FIG. 2-*a*, (c) is a diagram of the seal mechanism 111 as viewed from the upper side of FIG. 2-*a*, (d) is a perspective diagram of the seal mechanism 111, and (e) is a perspective diagram of the seal mechanism 111 as viewed from a direction different from that in (d).

As shown in FIG. 4, the resin member 111*a* is provided with an annular seal surface 111*c* that is partially protruded to the rotary pump 19 side. The suction-side void portions 19*c* and a gap between the cylinder 71 and an outer periphery of the outer rotor 19*a* that faces the suction-side void portions 19*c* are located on an inner peripheral side of the annular seal surface 111*c*. The discharge-side void portions 19*c* and a gap between the cylinder 71 and the outer periphery of the outer rotor 19*a* that faces the discharge-side void portions 19*c* are located on an outer peripheral side of the seal surface 111*c*. In other words, the sealing between a relatively low-pressure section and a relatively high-pressure section on the inner and outer peripheries of the seal mechanism 111 is performed by the seal surface 111*c*.

The resin member 111*a* is not formed in a circular shape, but is formed in a shape whose radial dimension from the drive shaft 54 gradually increases from the upper side to the lower side of the drawing. Further, the resin member 111*a* is provided with a projecting anti-rotation portion 111*d*. As shown in FIG. 2-*b*, a recessed portion 71*b* is formed in a position of the cylinder 71 that corresponds to the anti-rotation portion 111*d*. The anti-rotation portion 111*d* is fitted into the recessed portion 71*b*, and thus the resin member 111*a* can be inhibited from rotating in accordance with rotation of the drive shaft 54.

The inner peripheral side of a forward surface in the insertion direction of the resin member 111*a* is formed as a convex portion 111*e* that is protruded in the opposite direction to the rotary pump 19 in the axial direction. The annular rubber member 111*b* is arranged to surround the outer periphery of the convex portion 111*e*.

The annular rubber member 111*b* is formed by an O-ring, for example. The diameter of the cross section when the annular rubber member 111*b* is cut in the radial direction is set to be larger than an amount of protrusion of the convex portion 111*e*. Therefore, the annular rubber member 111*b* is compressed between the resin member 111*a* and the bottom of the recessed portion 101*a* of the housing 101, and the seal surface 111*c* of the resin member 111*a* is brought into contact with the rotary pump 19 by a restoring force of the annular rubber member 111*b*. With this type of structure, the above-described sealing by the seal surface 111*c* is achieved. Further, since the annular rubber member 111*b* comes into contact with the bottom of the recessed portion 101*a* of the housing 101, sealing is also achieved between the outer peripheral side and the inner peripheral side of the annular rubber member 111*b*, namely, between a high-pressure discharge port 80 side and the low-pressure drive shaft 54 side.

Outer diameters of the resin member 111*a* and the annular rubber member 111*b* are made smaller than an inner diameter of the recessed portion 101*a* of the housing 101, at least on the upper side of the drawing. Therefore, the brake fluid can flow through a gap between the recessed portion 101*a* of the housing 101, and the resin member 111*a* and the annular rubber member 111*b* on the upper side of the drawing. This gap forms the discharge port 80 and is connected to a discharge conduit 90 that is formed in the bottom of the recessed portion 101*a* of the housing 101. With this type of structure, the rotary pump 19 can discharge the brake fluid using the discharge port 80 and the discharge conduit 90 as a discharge path.

The inner peripheral side of the seal mechanism 111, namely, a section of the center hole that comes into contact with the drive shaft 54, is formed by a metal ring 111*f*. The metal ring 111*f* is integrally formed with the resin member 111*a*, or has an integrated structure with the resin member 111*a* by the resin member 111*a* being press fitted into a hollow portion 111*h*. The resin member 111*a* is arranged with a minimum clearance with respect to the drive shaft 54 so that the resin member 111*a* is in sliding contact with the drive shaft 54. Since the metal ring 111*f* is provided, the resin member 111*a* is inhibited from directly coming into contact with the drive shaft 54. As a result, even if the resin member 111*a* is deformed by the brake fluid pressure generated by the rotary pump 19, it is possible to inhibit tightening against the drive shaft 54 by the resin member 111*a* due to the deformation, namely, the occurrence of sticking by the resin member 111*a*.

A suction port 81, which communicates with the void portions 19*c* on the suction side of the rotary pump 19, is formed on the cylinder 71. The suction port 81 is extended from the end face of the cylinder 71 on the rotary pump 19 side to reach an outer peripheral surface of the cylinder 71, and is connected to a suction conduit 91 that is provided on a side surface of the recessed portion 101*a* of the housing 101. With this type of structure, the rotary pump 19 can introduce the brake fluid using the suction conduit 91 and the suction port 81 as a suction path.

On the other hand, the seal mechanism 112 is also formed by a ring-shaped member having a center hole into which the drive shaft 54 is inserted, and forms a seal between a relatively low-pressure section and a relatively high-pressure section on one end face side of the rotary pump 39, by pressing the outer rotor 39*a* and the inner rotor 39*b* to the cylinder 71 side. Specifically, the seal mechanism 112 is formed to include a hollow plate-shaped resin member 112*a* that is arranged on the rotating portion side, and a rubber member 112*b* that presses the resin member 112*a* to the rotating portion side.

FIG. 5 is a diagram showing a detailed structure of the seal mechanism 112 (in which the annular rubber member 112*b* is removed), (a) is a diagram of the seal mechanism 112 as viewed from the left side of FIG. 2-*a*, (b) is a diagram of the seal mechanism 112 as viewed from the right side of FIG. 2-*a*, (c) is a diagram of the seal mechanism 112 as viewed from the upper side of FIG. 2-*a*, (d) is a perspective diagram of the seal mechanism 112, and (e) is a perspective diagram of the seal mechanism 112 as viewed from a direction different from that in (d).

As shown in FIG. 5, the resin member 112*a* is provided with an annular seal surface 112*c* that is partially protruded to the rotary pump 39 side. The suction-side void portions 39*c* and a gap between the cylinder 71 and the outer periphery of the outer rotor 39*a* that faces the suction-side void portions 39*c* are located on an inner peripheral side of the annular seal surface 112*c*. The discharge-side void portions 39*c* and a gap between the cylinder 71 and the outer periphery of the outer rotor 39*a* that faces the discharge-side void portions 39*c* are located on an outer peripheral side of the seal surface 112*c*. In other words, the sealing between a relatively low-pressure section and a relatively high-pressure section on the inner and outer peripheries of the seal mechanism 112 is performed by the seal surface 112*c*.

The resin member 112*a* is not formed in a circular shape, but is formed in a shape whose radial dimension from the drive shaft 54 gradually reduces from the upper side to the lower side of the drawing. Further, the resin member 112*a* is provided with a projecting anti-rotation portion 112*d*. As shown in FIG. 2-*b*, a recessed portion 71*c* is formed in a position of the cylinder 71 that corresponds to the anti-rotation portion 112*d*. The anti-rotation portion 112*d* is fitted into the recessed portion 71*c*, and thus the resin member 112*a* can be inhibited from rotating in accordance with rotation of the drive shaft 54.

The inner peripheral side of a rearward surface in the insertion direction of the resin member 112*a* is formed as a convex portion 112*e* that is protruded in the opposite direction to the rotary pump 39 in the axial direction. The annular rubber member 112*b* is arranged to surround the outer periphery of the convex portion 112*e*.

The annular rubber member 112*b* is formed by an O-ring, for example. The diameter of the cross section when the annular rubber member 112*b* is cut in the radial direction is set to be larger than an amount of protrusion of the convex portion 112*e*. Therefore, the annular rubber member 112*b* is compressed between the resin member 112*a* and the plug 72, and the seal surface 112*c* of the resin member 112*a* is brought into contact with the rotary pump 39 by a restoring force of the annular rubber member 112*b*. With this type of structure, the above-described sealing by the seal surface 112*c* is achieved. Further, since the annular rubber member 112*b* comes into contact with a recessed portion of the plug 72, sealing is also achieved between the outer peripheral side and the inner peripheral side of the annular rubber member 112*b*, namely, between a high-pressure discharge port 82 side and the low-pressure drive shaft 54 side.

Outer diameters of the resin member 112*a* and the annular rubber member 112*b* are made smaller than an inner diameter of the plug 72, at least on the lower side of the drawing. Therefore, the brake fluid can flow through a gap between the plug 72, and the resin member 112*a* and the annular rubber member 112*b* on the lower side of the drawing. This gap forms the discharge port 82, and is connected to a communication passage 72*b* formed in the plug 72 and a discharge conduit 92 formed in a side surface of the recessed portion 101*a* of the housing 101. With this type of structure, the rotary pump 39 can discharge the brake fluid using, as a discharge path, the discharge port 82, the communication passage 72*b* and the discharge conduit 92.

The inner peripheral side of the seal mechanism 112, namely, a section of the center hole that comes into contact with the drive shaft 54 is formed by a metal ring 112*f*. The metal ring 112*f* is integrally formed with the resin member 112*a*, or has an integrated structure with the resin member 112*a* by the resin member 112*a* being press fitted into a hollow portion 112*h*. Since the metal ring 112*f* is provided, the resin member 112*a* is inhibited from coming into contact with the drive shaft 54. As a result, even if the resin member 112*a* is deformed by the brake fluid pressure generated by the rotary pump 39, it is possible to inhibit tightening against the drive shaft 54 by the resin member 112*a* due to the deformation, namely, the occurrence of sticking by the resin member 112*a*.

On the other hand, an end face of the cylinder 71 on the rotary pumps 19, 39 side is also used as a seal surface, and the rotary pumps 19, 39 are firmly attached to the seal surface, thereby forming a mechanical seal. Thus, a relatively low-pressure section and a relatively high-pressure section on the other end face side of the rotary pumps 19, 39 are sealed.

A suction port 83, which communicates with the void portions 39*c* on the suction side of the rotary pump 39, is formed on the cylinder 71. The suction port 83 is extended from the end face of the cylinder 71 on the rotary pump 39 side to reach the outer peripheral surface of the cylinder 71, and is connected to a suction conduit 93 that is provided on a side surface of the recessed portion 101*a* of the housing 101. With this type of structure, the rotary pump 39 can introduce the brake fluid using the suction conduit 93 and the suction port 83 as a suction path.

Note that, in FIG. 2-*a*, the suction conduit 91 and the discharge conduit 90 correspond to the conduit C in FIG. 1, and the suction conduit 93 and the discharge conduit 92 correspond to the conduit G in FIG. 1.

A sealing member 120 is housed in the center hole 71*a* of the cylinder 71, at a position rearward of the first bearing 51 in the insertion direction. The sealing member 120 is formed by an annular resin member 120*a* having a U-shaped cross section in the radial direction, and an annular rubber member 120*b* that is fitted into the annular resin member 120*a*. In the seal member 120, the annular resin member 120*a* is pressed and compressed by the cylinder 71 and the drive shaft 54, and the annular rubber member 120*a* is thereby compressed. The annular resin member 120*a* comes into contact with the cylinder 71 and the drive shaft 54 by an elastic reaction force of the annular rubber member 120*b*, thereby forming a seal between them. As a result, sealing between the two systems is achieved inside the center hole 71*a* of the cylinder 71.

Further, the center hole 72*a* of the plug 72 has a stepped shape in which the inner diameter is changed in three steps from the front to the rear in the insertion direction, and a seal member 121 is housed in a first stepped portion that is located on the rearmost side in the insertion direction. The seal member 121 is made by fitting a ring-shaped elastic ring 121*a*, which is made of an elastic member such as rubber, into a ring-shaped resin member 121*b*, in which a groove portion is formed such that its radial direction is taken as the depth direction. Due to an elastic force of the elastic ring 121*a*, the resin member 121*b* is pressed and comes into contact with the drive shaft 54.

Figure 6:
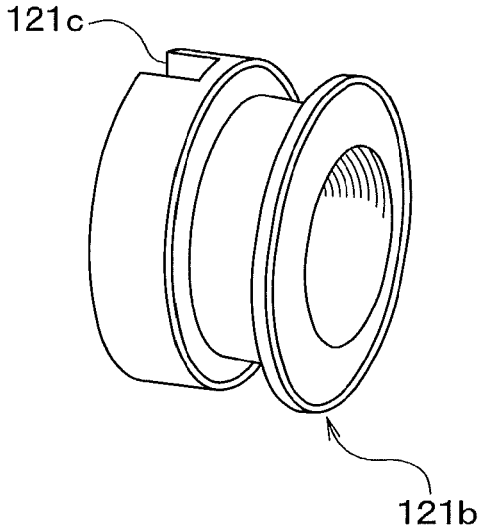
FIG. 6 is a perspective diagram of a resin member 121*b* of a seal member 121.

FIG. 6 is a perspective diagram of the resin member 121*b* of the seal member 121. As shown in FIG. 6, a slit 121*c* is formed on the seal mechanism 112 side of the resin member 121*b*. A protruding portion 112*g* of a metal ring 112*f* provided in the seal mechanism 112 is fitted into the slit 121*c*. As a result, the seal member 121 and the seal mechanism 112 are engaged with each other, which restricts the rotation of the seal member 121 along with the rotation of the drive shaft 54.

Note that the above-described seal mechanism 112 is housed in a second stepped portion, which corresponds to a step of the center hole 72*a* that is adjacent to the step on which the seal member 121 is arranged. The above-described communication passage 72*b* is formed from the second stepped portion to reach the outer peripheral surface of the plug 72. Further, a rear end of the cylinder 71 in the insertion direction is press fitted into a third stepped portion that is located on the frontmost side of the center hole 72*a* in the insertion direction. A portion of the cylinder 71 that is fitted into the center hole 72*a* of the plug 72 has a reduced outer diameter compared to the other portions of the cylinder 71. An axial direction dimension of the portion of the cylinder 71 that has the reduced outer diameter is made larger than an axial direction dimension of the third stepped portion of the center hole 72*a*. Therefore, when the cylinder 71 is press fitted into the center hole 72*a* of the plug 72, a groove portion 74*c* is formed by the cylinder 71 and the plug 72, at a leading end position of the plug 72.

The diameter of the center hole 72*a* of the plug 72 is partially enlarged also at the rear side in the insertion direction, and an oil seal (a seal member) 122 is provided on this enlarged portion. In this manner, since the oil seal 122 is arranged closer to the motor 60 than the seal member 121, leakage of the brake fluid to the outside through the center hole 72*c* is basically inhibited by the seal member 121, and an effect thereof is more reliably obtained by the oil seal 122.

On the outer periphery of the pump body 100 that is structured in this manner, O-rings 73*a* to 73*d*, which are annular seal members, are provided to perform sealing between respective portions. The O-rings 73*a* to 73*d* are used to seal the brake fluid between the two systems formed in the housing 101, and between the discharge path and the suction path of each of the two systems. The O-ring 73*a* is arranged between a section including the discharge port 80 and the discharge conduit 90 and a section including the suction port 81 and the suction conduit 91. The O-ring 73*b* is arranged between the section including the suction port 81 and the suction conduit 91 and a section including the suction port 83 and the suction conduit 93. The O-ring 73*c* is arranged between the section including the suction port 83 and the suction conduit 93 and a section including the discharge port 82 and the discharge conduit 92. The O-ring 73*d* is arranged between the section including the discharge port 82 and the discharge conduit 92 and the outside of the housing 101. Here, the O-rings 73*a*, 73*c*, 73*d* are each simply arranged in a circular shape such that they surround the outer periphery centered on the drive shaft 54, while the O-ring 73*b* is arranged to be displaced in the axial direction although it surrounds the outer periphery centered on the drive shaft 54. Detailed structures will be described with reference to FIG. 7.

Figure 7:
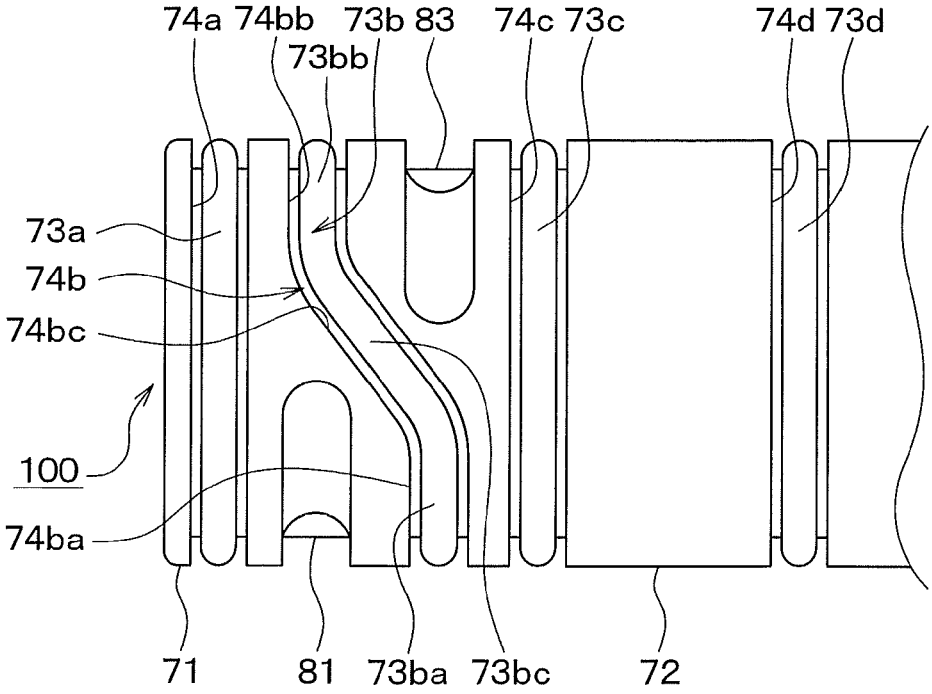
FIG. 7 is a diagram showing portions of the pump body 100, in which O-rings 73*a* to 73*d* are arranged.

FIG. 7 is a diagram showing portions of the pump body 100, in which the O-rings 73*a* to 73*d* are arranged. As shown in FIG. 7, the outer periphery of the pump body 100 is provided with groove portions 74*a* to 74*d* in which the O-rings 73*a* to 73*d* are arranged. The groove portions 74*a*, 74*b* are formed by partially recessing the outer periphery of the cylinder 71. The groove portion 74*c* is formed by a recessed portion in the outer periphery of the cylinder 71 and a leading end portion of the plug 72. The groove portion 74*d* is formed by partially recessing the outer periphery of the plug 72.

The groove portions 74*a*, 74*c*, 74*d* are each provided in a circular shape centered on the central axis of the pump body 100 (the central axis of the drive shaft 54). Therefore, the O-rings 73*a*, 73*c*, 73*d* that are respectively provided in the groove portions 74*a*, 74 *c*, 74*d* also have a circular shape.

In contrast to the above, the groove portion 74*b* is arranged to be displaced in the axial direction although it surrounds the outer periphery centered on the drive shaft 54. The suction ports 81, 83 are arranged on the outer periphery of the pump body 100 such that they are displaced from each other in the circumferential direction of the pump body 100. However, the groove portion 74*b* is structured such that it includes a first portion 74*ba* that is arranged side by side with the suction port 81 in the axial direction, a second portion 74*bb* that is arranged side by side with the suction port 83, and a third portion 74*bc* that connects these portions. The first portion 74*ba* and the second portion 74*bb* are arranged to be displaced from each other in the axial direction. When the pump body 100 is viewed in the radial direction, the third portion 74*bc* is extended diagonally with respect to the circumferential direction between the suction port 81 and the suction port 83. Accordingly, the O-ring 73*b* that is arranged in the groove portion 74*b* structured in this manner also has a shape that includes a first portion 73*ba* that is arranged side by side with the suction port 81 in the axial direction, a second portion 73*bb* that is arranged side by side with the suction port 83, and a third portion 73*bc* that connects these portions. The first portion 73*ba* and the second portion 73*bb* are arranged to be displaced from each other in the axial direction. When the pump body 100 is viewed in the radial direction, the third portion 73*bc* is extended diagonally between the suction port 81 and the suction port 83. The O-ring 73*b* structured in this manner may be an O-ring that is formed in advance to have a similar shape to that of the groove portion 74*b*. However, it may have a circular shape similarly to the other O-rings 73*a*, 73*c*, 73*d*. More specifically, the O-ring 73*b* may be fitted into the groove portion 74*b* by elastically deforming the O-ring 73*b* so that the O-ring 73*b* takes the shape of the groove portion 74*b*.

Note that the suction ports 81, 83 are extended in the circumferential direction with respect to the cylinder 71 as shown in FIG. 7. Since they are extended in this manner, displacement between the suction ports 81, 83 and the suction conduits 91, 93 is inhibited when the pump body 100 is assembled into the recessed portion 101*a* of the housing 101. At the same time, an accumulated amount of the brake fluid is increased along with an increase in volume of the suction paths. Since the volume of the suction paths is increased in this manner, when the brake fluid is sucked, it is possible to inhibit the rotary pumps 19, 39 from being unable to suck the brake fluid due to insufficient brake fluid.

Further, the diameter of the outer peripheral surface of the plug 72 is reduced at the rear side in the insertion direction, and a stepped portion is thereby formed. The above-described ring-shaped male screw member 102 is fitted into this reduced diameter portion, and the pump body 100 is thereby fixed.

The rotary pump device is structured as described above. In the rotary pump device structured in this way, the incorporated rotary pumps 19, 39 perform a pump operation of suction/discharge of the brake fluid in response to the drive shaft 54 being rotated by a rotation axis of the motor 60. As a result, vehicle motion control, such as antiskid control, is performed by the vehicle brake device.

In the rotary pump device, when the rotary pump device performs the pump operation, the discharge pressure of the rotary pumps 19, 39 is introduced to portions of the resin members 111*a*, 112*a* that are located on an opposite side to the rotary pumps 19, 39, the resin members 111*a*, 112*a* being provided in the two seal mechanisms 111, 112. Therefore, a high discharge pressure is applied to the two seal mechanisms 111, 112 in a direction to pressurize them from the outside of the cylinder 71, and the seal surfaces 111*c*, 112*c* of the two seal mechanisms 111, 112 are pressed against the rotary pumps 19, 39 while the other end faces in the axial direction of the rotary pumps 19, 39 are pressed against the cylinder 71. As a result, while the one end faces in the axial direction of the rotary pumps 19, 39 are sealed by the two seal mechanisms 111, 112, the other end faces in the axial direction of the rotary pumps 19, 39 can be mechanically sealed by the cylinder 71.

In this manner, the two seal mechanisms 111, 112 are structured such that they are pressed from the outside of the cylinder 71 at a discharge pressure. Therefore, the both end faces of the rotary pumps 19, 39 can be sealed without requiring a member that generates an axial force to mechanically press the seal mechanisms 111, 112.

In the present embodiment, since this type of rotary pump device has the structure described above, the following effects can be obtained.

(1) In the rotary pump device of the present embodiment, the rotary pumps 19, 39, the cylinder 71 and the seal mechanisms 111, 112 are assembled using the drive shaft 54 as a reference. Specifically, the cylinder 71 is assembled to the drive shaft 54 via the first bearing 51. The first bearing 51 has a very small dimensional tolerance in the radial direction. In addition, the needle-shaped roller 51*b* on the inner periphery of the first bearing 51 comes directly into contact with the drive shaft 54, and the outer ring 51*a* on the outer periphery comes directly into contact with the center hole 71 a of the cylinder 71. Therefore, the cylinder 71 and the drive shaft 54 can be assembled with almost no axial displacement. Moreover, the seal mechanisms 111, 112 can be assembled such that the drive shaft 54 is inserted with a minimum clearance from the inner periphery of the metal rings 111*f*, 112*f*. Therefore, the seal mechanisms 111, 112 and the drive shaft 54 can be assembled together with almost no axial displacement.

Accordingly, the cylinder 71 and the seal mechanisms 111, 112 that have been assembled using the drive shaft 54 as a reference are assembled with almost no assembly error on the both end faces of the rotary pumps 19, 39. As a result, it is possible to further reduce the assembly error and it is thus possible to improve pump efficiency.

(2) Further, in the rotary pump device of the present embodiment, the projecting anti-rotation portions 111*d*, 112*d* are provided for the resin members 111*a*, 112*a* of the seal mechanisms 111, 112, and the recessed portions 71*b*, 71*c* are provided in positions of the cylinder 71 that correspond to the anti-rotation portions 111*d*, 112*d*. The anti-rotation portion 111*d* is fitted into the recessed portion 71*b* so that the resin member 111*a* does not rotate along with rotation of the drive shaft 54.

In this manner, an anti-rotation structure of the seal mechanisms 111, 112 can be formed by the anti-rotation portions 111*d*, 112*d* and the recessed portions 71*b*, 71*c*, and using these portions, it is also possible to perform positioning in the circumferential direction of the seal mechanisms 111, 112 with respect to the cylinder 71. Accordingly, with the use of the anti-rotation portions 111*d*, 112*d* and the recessed portions 71*b*, 71*c*, it is possible to suppress a positional displacement in a rotational direction of the cylinder 71 and of the seal mechanisms 111, 112, and it is possible to further reduce the assembly error. As a result, it is possible to further improve the pump efficiency.

(3) Further, in the rotary pump device of the present embodiment, the cylinder 71 and the plug 72 are made of aluminum. As a result, it is possible to achieve a reduction in an axial direction length of the pump body 100 as well as weight reduction, which will be described below.

More specifically, in a rotary pump device of related art, since a rotary pump is slidably moved at high pressure, each rotor included in the rotary pump and a casing that houses the rotary pump are made of a steel material. However, a housing of a brake fluid pressure control actuator is made of aluminum for the purpose of weight reduction. In order to inhibit damage caused by thermal stress in an axial direction that is generated by a difference between linear expansion coefficients of the steel material and aluminum, a relative displacement due to thermal stress between a pump body and the housing in the axial direction can be absorbed by a disc spring or the like. For that reason, the reduction in an axial direction length of the pump body cannot be achieved sufficiently.

Accordingly, when the cylinder 71 and the plug 72 are made of aluminum as in the present embodiment, they can be made of the same material as that of the housing 101 made of aluminum. As a result, since there is no difference between their thermal expansion coefficients, there is no need to take account of absorption of the thermal stress. As a result, there is no need to provide a disc spring or the like that is necessary in the related art, and it is therefore possible to achieve a further reduction in the axial direction length of the pump body 100 as well as weight reduction.

Note that portions of the cylinder 71 that form the rotor chambers 100*a*, 100*b*, in which the rotary pumps 19, 39 are respectively housed, serve as sliding surfaces of the respective rotors 19*a*, 19*b*, 39*a*, 39*b*. Therefore, it is preferable to perform surface modification by, for example, alumite treatment, thermal spraying or the like. By performing this type of surface modification, it is possible to improve hardness of the sliding surfaces and to improve abrasion resistance during sliding movement. Note that, although "made of aluminum" is explained here, it means an aluminum material that also contains an aluminum alloy, without being limited to pure aluminum.

(4) Further, in the rotary pump device of the present embodiment, a relatively low-pressure section and a relatively high-pressure section on the one end face side of the rotary pumps 19, 39 are sealed by the seal mechanisms 111, 112. Therefore, in addition to the counterbores on the both end faces of the cylinder 71, the seal mechanisms 111, 112 are used to form the rotor chambers 100*a*, 100*b*. In other words, the seal mechanisms 111, 112 form a part of a wall surface to form the rotor chambers 100*a*, 100*b*.

In the related art, cylinder components are respectively disposed on the both end faces of the rotary pump, and at the same time, a hollow center plate that surrounds the periphery of the rotary pump is arranged. Thus, the two cylinder components and the center plate form a rotor chamber. For that reason, the cylinder components are welded to the outer periphery of the center plate to integrate them.

In contrast to this, in the present embodiment, since the seal mechanisms 111, 112 form a part of the rotor chambers 100*a*, 100*b*, the rotor chambers 100*a*, 100*b* are formed by the single cylinder 71 and the seal mechanisms 111, 112. Therefore, there is no section to be welded. In addition, a relatively low-pressure section and a relatively high-pressure section on the one end face side of the rotary pumps 19, 39 are sealed by the seal mechanisms 111, 112. Accordingly, there is no need to have a structure in which a seal member to seal these sections is housed inside the cylinder component as in the related art. For that reason, the layout of the seal mechanisms 111, 112 themselves into the cylinder 71 becomes easy, and the layout of the annular rubber members 111*b*, 112*b*, which are arranged on an outer peripheral portion, also becomes easy. Moreover, it is possible to omit the cylinder components that are provided in the related art to form the rotor chamber. Thus, it is also possible to achieve a further reduction in the axial direction length.

Further, the following structure is adopted so that the seal mechanisms 111, 112 form a part of the wall surface to form the rotor chambers 100*a*, 100*b*, while the relatively low-pressure section and the relatively high-pressure section on the one end face side of the rotary pumps 19, 39 are sealed by the seal mechanisms 111, 112 as described above.

Specifically, the seal members 121, 122 are held by the plug 72. Further, the annular rubber members 111*b*, 112*b* of the seal mechanisms 111, 112 are used not only to press the resin members 111*a*, 112*a* against the rotary pumps 19, 39, but also to form a seal between the high-pressure discharge ports 80, 82 side and the low-pressure drive shaft 54 side. Further, the cylinder 71 has a retention function of the first bearing 51, and at the same time, the outer periphery of the cylinder 71 is used to form a seal between the two systems and between the discharge path and the suction path of each of the two systems. Further, by increasing the size of the resin members 111*a*, 112*a* in the seal mechanisms 111, 112, seal surfaces are formed and at the same time, it becomes possible to assemble the annular rubber members 111*b*, 112*b*. In addition, by providing the metal rings 111*f*, 112*f*, the resin members 111*a*, 112*a* can also be used as strength members.

With this type of structure, it is possible to achieve a reduction in the number of components, as compared to a case in which, as in the related art, the cylinder components are respectively disposed on the both end faces of the rotary pump, and at the same time, the hollow center plate that surrounds the periphery of the rotary pump is arranged, so that the rotor chamber is formed by the two cylinder components and the center plate. Accordingly, the rotary pump device can have a simpler structure, and it is also possible to achieve a reduction in product cost due to the reduction in the number of components.

(5) Further, in the rotary pump device of the present embodiment, the slit 121*c* is formed in the resin member 121*b* on the seal mechanism 112 side, and the protruding portion 112*g* of the metal ring 112*f* is fitted into the slit 121*c*. With this type of structure, the seal member 121 and the seal mechanism 112 are engaged with each other so as to restrict rotation of the seal member 121 along with rotation of the drive shaft 54.

In the related art, a hole is provided in the radial direction with respect to the cylinder component that corresponds to the plug 72, an anti-rotation pin is arranged in the hole, and the anti-rotation pin is fitted into a slit provided in a component that corresponds to the resin member 121*b*. Thus, the rotation of the seal member along with the rotation of the drive shaft is restricted. However, in this type of structure, since the anti-rotation pin is required, the number of components increases and an axial direction length corresponding to a length to arrange the anti-rotation pin is required.

In contrast to this, in the present embodiment, since the protruding portion 112*g* is provided on the metal ring 112*f* and the slit 121*c* is provided in the resin member 121*b*, the rotation of the seal member 121 along with the rotation of the drive shaft 54 is restricted. Therefore, it is possible to omit the anti-rotation pin and it is therefore possible to achieve a reduction in the number of components. In addition, the axial direction length to arrange the anti-rotation pin is not required, and it is therefore possible to achieve a further reduction in the axial direction length.

(6) Further, in the rotary pump device of the present embodiment, the O-ring 73*b* has a shape that includes the first portion 73*ba* that is arranged side by side with the suction port 81 in the axial direction, the second portion 73*bb* that is arranged side by side with the suction port 83, and the third portion 73*bc* that connects these portions. Further, the first portion 73*ba* and the second portion 73*bb* are arranged to be displaced from each other in the axial direction. When the pump body 100 is viewed in the radial direction, the third portion 73*bc* has such a shape that it is extended diagonally with respect to the circumferential direction between the suction port 81 and the suction port 83.

Therefore, the two suction ports 81, 83 can be located closer to each other in the axial direction. Accordingly, it is possible to reduce the axial direction length of the pump body 100, and it is possible to achieve a size reduction of the rotary pump device.

Other Embodiments

In the above-described embodiment, an example of the rotary pump device is described in which the cylinder 71 and the seal mechanisms 111, 112 can be assembled using the drive shaft 54 as a reference. However, the respective portions that form the rotary pump device can be appropriately changed in design.

For example, the metal rings 111*f*, 112*f* are provided in the hollow portions 111*h*, 112*h* of the resin members 111*a*, 112*a*, as reinforcing rings to reinforce the resin members 111*a*, 112*a*. However, they need not necessarily be made of metal as long as their hardness is higher than that of the material used to form the resin members 111*a*, 112*a*, and another material (ceramic, for example) can be used. In other words, any material can be used as long as the material can suppress sticking to the drive shaft 54 due to deformation of the resin members 111*a*, 112*a* when a high pressure is applied.

Further, although the first bearing 51 is formed by the needle roller bearing without inner ring, the first bearing 51 may be formed by another roller bearing. In addition, the first bearing 51 may be arranged on the outside of the cylinder 71 and the cylinder 71 may be directly arranged with a minimum clearance from the drive shaft 54. In this manner, even when the first bearing 51 is arranged on the outside of the cylinder 71, the cylinder 71 is arranged with the minimum clearance, using the drive shaft 54 as a reference. Therefore, the axial displacement between the cylinder 71 and the seal mechanisms 111, 112 can be suppressed, and it is possible to achieve an improvement in pump efficiency.

Further, the protruding portion 112*g* is provided on the seal mechanism 112 and the slit 121*c* is provided in the seal member 121, as the protruding and recessed portions that are engaged with each other in order to inhibit rotation of the seal member 121 that abuts on the seal mechanism 112. However, the members on which the protruding and recessed portions are formed may be reversed, and the protruding portion may be provided on the seal member 121 side and the recessed portion may be provided on the metal ring 112*f* of the seal mechanism 112. In a similar manner, the projecting anti-rotation portions 111*d*, 112*d* are provided for the seal mechanisms 111, 112 and the recessed portions 71*b*, 71*c* are provided for the cylinder 71, as the projecting and recessed portions that are engaged with each other in order to inhibit rotation of the seal mechanisms 111, 112. However, the members on which the protruding and recessed portions are formed may be reversed, and the recessed portions may be provided in the seal mechanisms 111, 112 and the protruding portions may be provided on the cylinder 71.

Further, a case is explained in which the cylinder 71 and the plug 72 that form the casing are formed of the same material (aluminum) as that of the housing 101, in order to obtain an effect of inhibiting damage caused by the thermal stress in the axial direction that is generated by a difference between linear expansion coefficients of the steel material and aluminum. However, this is not intended to inhibit the cylinder 71 and the plug 72 from being formed of another material. For example, if the thermal stress can be absorbed using another device, even if the cylinder 71 and the plug 72 are formed of another material, it is possible to inhibit occurrence of damage caused by the thermal stress.

The invention claimed is:

1. A rotary pump device comprising:

a rotary pump which includes an outer rotor and an inner rotor and which is driven by a drive shaft;

a cylinder which forms a rotor chamber in which the rotary pump is housed, and forms a mechanical seal by coming into contact with one end face in an axial direction of the outer rotor and the inner rotor, and which includes a center hole into which the drive shaft is inserted; and a seal mechanism which forms the rotor chamber together with the cylinder, and which includes a hollow plate-shaped resin member having a seal surface that comes into contact with another end face in the axial direction of the outer rotor and the inner rotor, and a hollow portion into which the drive shaft is inserted, the seal mechanism pressing the seal surface against the rotary pump by introducing a discharge pressure of the rotary pump to a side of the resin member that is opposite to the rotary pump, and the seal mechanism including a reinforcing ring in the hollow portion of the resin member, the reinforcing ring being formed of a material whose hardness is higher than that of the resin member, and having an inner peripheral surface that is caused to be slidably in contact with the drive shaft.

2. The rotary pump device according to claim 1, further comprising:

a seal member which surrounds a periphery of the drive shaft and which abuts on the seal mechanism, wherein protruding and recessed portions that are engaged with each other are respectively formed on the seal mechanism and the seal member, and the protruding and recessed portions restrict rotation of the seal member along with rotation of the drive shaft.

3. The rotary pump device according to claim 1 wherein the rotary pump and the seal mechanism are doubly provided, each pair of the rotary pump and the seal mechanism is provided on each side in an axial direction of the cylinder, and the two seal mechanisms are pressed toward the cylinder by a discharge pressure, and thus the two rotary pumps are pressed by the two seal mechanisms.

4. The rotary pump device according to claim 1, wherein a bearing that supports the drive shaft is provided in the center hole of the cylinder.

5. The rotary pump device according to claim 1, wherein the seal mechanism includes an anti-rotation structure that restricts the seal mechanism from rotating in a circumferential direction of the drive shaft.

6. The rotary pump device according to claim 1, wherein a housing is formed of an aluminum material as is the case with the cylinder, the housing having an inner space in which the rotary pump and the cylinder are housed.

* * * * *